US005693005A

United States Patent [19]

Vistung

[11] Patent Number: 5,693,005

[45] Date of Patent: Dec. 2, 1997

[54] MOBILE CARDIAC MASSAGE APPARATUS

[76] Inventor: Willy Vistung, Kastanjeveien 5, N-0487 Oslo, Norway

[21] Appl. No.: 612,861

[22] PCT Filed: Sep. 22, 1994

[86] PCT No.: PCT/NO94/00156

§ 371 Date: Mar. 12, 1996

§ 102(e) Date: Mar. 12, 1996

[87] PCT Pub. No.: WO95/08316

PCT Pub. Date: Mar. 30, 1995

[30] Foreign Application Priority Data

Sep. 24, 1993 [NO] Norway ..... 933422

[51] Int. Cl.[6] ..... A61H 31/00

[52] U.S. Cl. ..... 601/41; 601/106; 128/204.26

[58] Field of Search ..... 601/1, 41–44, 601/106, 107, 108, 134, 135; 128/204.18, 204.23, 204.26

[56] References Cited

U.S. PATENT DOCUMENTS

| | | | |
|---|---|---|---|
| 2,436,853 | 3/1948 | Coleman | 601/44 |
| 3,254,645 | 6/1966 | Rand et al. | 601/41 |
| 3,307,541 | 3/1967 | Hewson . | |
| 3,336,920 | 8/1967 | Thomas | 601/106 |
| 3,348,536 | 10/1967 | Tambascia | 601/106 |
| 3,509,899 | 5/1970 | Hewson | 601/41 |
| 4,340,045 | 7/1982 | Manley | 128/204.26 |
| 4,345,592 | 8/1982 | Glorgini et al. | 128/204.26 |
| 4,721,133 | 1/1988 | Sundblom | 601/43 |
| 5,357,950 | 10/1994 | Wippler et al. | 128/204.26 |

FOREIGN PATENT DOCUMENTS

| | | |
|---|---|---|
| 0 010 908 | 5/1980 | European Pat. Off. . |
| 7 505 469 | 7/1976 | Sweden . |
| 1140582 | 1/1969 | United Kingdom . |

*Primary Examiner*—Jeanne M. Clark
*Attorney, Agent, or Firm*—Browdy and Neimark

[57] ABSTRACT

A mobile cardiac massage apparatus is described which comprises a pressure cylinder containing a medium suitable for supplying to a person with reduced or interrupted lung function, connected with a thrusting device for provision of cardiac compression. The apparatus comprises an automatic control device, which actuates cardiac compression, consisting of pressure regulated 3/2 valve open in the start phase, a time regulated valve closed in the start phase, a control link to determine the duration of the cardiac compression, and a unistable 5/2 valve, and having a breathing mask, there being a control means in operative connection with the automatic control device and the breathing mask.

3 Claims, 2 Drawing Sheets

MOBILE CARDIAC MASSAGE APPARATUS

The present invention relates to a mobile apparatus for cardiac massage. More specifically, the present invention provides an apparatus for resuscitation of patients with cardiac arrest by means of cardiac compression combined with artificial ventilation.

Resuscitation as mentioned above is difficult to carry out correctly, partly because cardiac compression is physically very strenuous, and a person must be well practiced and experienced in order to execute it correctly. Further, it is difficult to coordinate the cardiac compressions with ventilation into the lungs at the correct tempo and with the necessary pause in the compressions. This type of resuscitation is difficult to carry out at a hospital under optimal conditions, very difficult outside a hospital and almost impossible in a moving ambulance and in rescue helicopters.

There has recently been developed an apparatus for automatic cardiac compression. In the event of a cardiac arrest, the patient is fastened securely to an equipment case by means of two shoulder straps and a plastic bar across the chest. On this bar is positioned a piston that receives energy pulses through a tube from a hydraulic unit inside the case. The hydraulic pump is driven by a battery.

Although this apparatus improves the potential for saving lives, it is nevertheless burdened with some critical disadvantages. First, the apparatus is dependent on electricity or battery power. Also, this solution provides for cardiac compression only.

In EP 0010908-A1 an apparatus for cardiac treatment is described. The apparatus discussed in this publication is far more complicated than the device according to the present invention and includes electrodes for electrical cardiac stimulation. One of these electrodes is guided into the patient's oesophagus to the area under the heart, the other is placed on the surface of the compression device, which is pressed against the patient's chest. This is an apparatus which must be operated by trained personnel.

SE 7505469-2 relates to a device for ventilating a person, where the major emphasis is placed on the regulation of the piston stroke length and the oxygen volume that is introduced in accordance with the size of the patient.

U.S. Pat. No. 1,140,581 describes a heart-lung resuscitation device that is pneumatically driven. It is apparent, however, that the control system used here is far more complicated, and thus more sensitive, than the control system of the present invention.

U.S. Pat. No. 3307541 similarly describes an apparatus for cardiac treatment. This is also much more complicated than the device in accordance with the present invention. It includes, among other features, an air motor which drives some of the valves. The air motor is, in turn, driven by means of oxygen that is transferred from the oxygen container over into a smaller tank.

With the present invention there is provided an apparatus for a mobile heart massage unit comprising a pressure cylinder, containing a medium suitable for supplying to a person with reduced or interrupted lung function, connected with a thrust device for provision of cardiac compression, characterized in that it comprises an automatic control device which actuates the cardiac compression, consisting of a pressure regulated 3/2 valve that is open in the start phase, a time regulated valve that is closed in the start phase, a control link for determining the duration of the cardiac compression and a unistable 5/2 valve, and having a breathing mask, there being a control means (also herein referred to as a control bypass valve in operative the automatic control device and the breathing mask.

The apparatus according to the invention may also be employed without the compression function, i.e., with supplying of oxygen only.

A preferred embodiment of the invention is characterized in that the control device is manual and consists of a switch 76 which halts the cardiac compression simultaneously with the supplying of a respiratory medium to the injured person's lungs, and vice versa.

With the apparatus according to the invention, a number of advantages are attained compared with the primarily manual treatment used today:

- The apparatus provides for automatic cardiac compression with the aid of a pressure controlled piston having a compression pad that is placed over the heart region. The compression rate and pressure may be regulated as desired.
- On introduction of the respiratory medium into the patient's lungs, the cardiac compression stops automatically. When ventilation with the respiratory medium is completed, the cardiac compression automatically resumes at the same tempo. This function ensures that treatment will be correct and is a safeguard against faulty treatment.
- The ventilating mask (also referred to as a breathing mask) is equipped with a demand and by-pass function, whereby the patient on awakening automatically receives the amount of oxygen he requires. The by-pass valve is a safety valve that is released at a counterpressure of 45 cm water column.
- A significant advantage is that the apparatus is independent of external power sources and is driven by its own respiratory medium cylinder.
- The apparatus is easy to use and is light-weight.

As respiratory medium, in connection with the apparatus according to the invention, there may be used media such as air, oxygen and/or "Entonox". The use of oxygen for ventilation also affords the advantage of enabling more effective oxygenation of the patient as compared with treatment with air. Entonox may be advantageous if it is an objective to relieve pain at the same time.

The ventilation can take place both with the aid of a breathing mask and by means of a tube.

The invention will be described in more detail in the following, with reference to the drawings, where:

Figure 1:
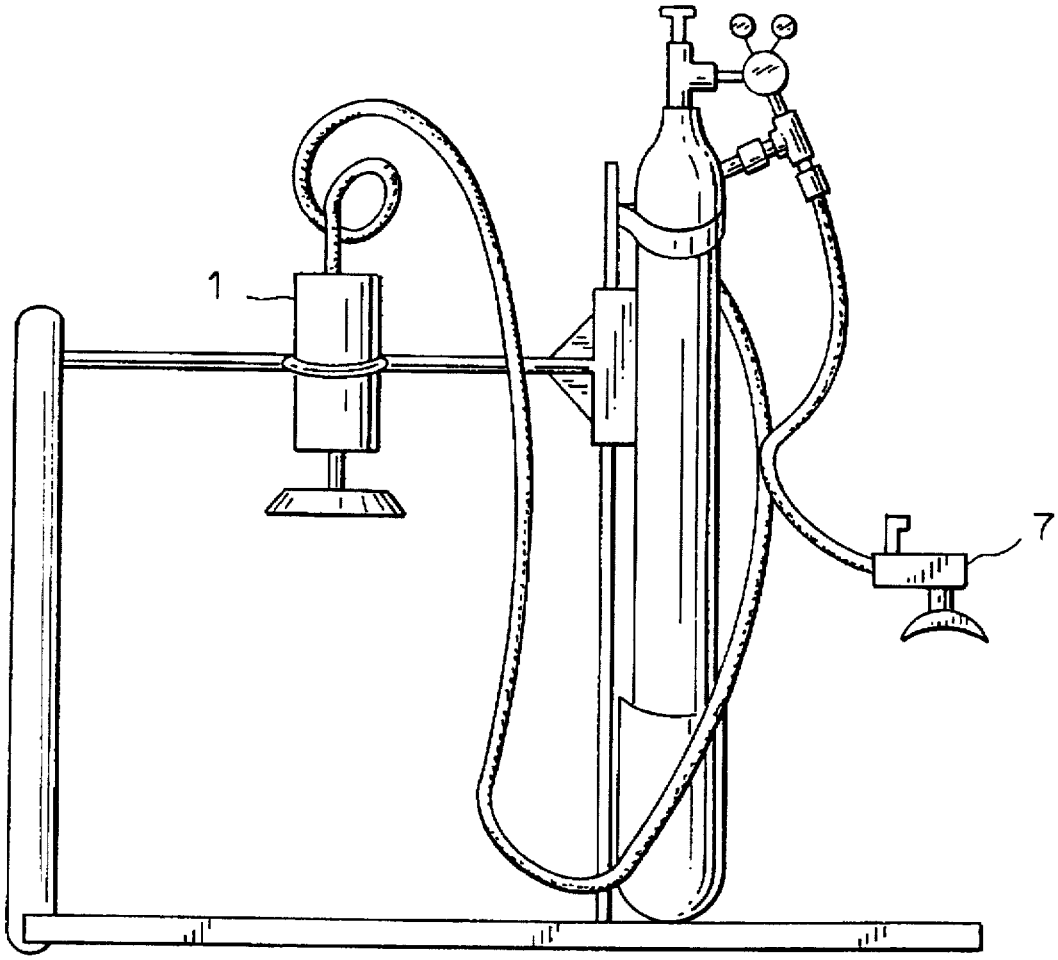
FIG. 1 is a schematic sketch of the apparatus according to the invention.
Figure 2:
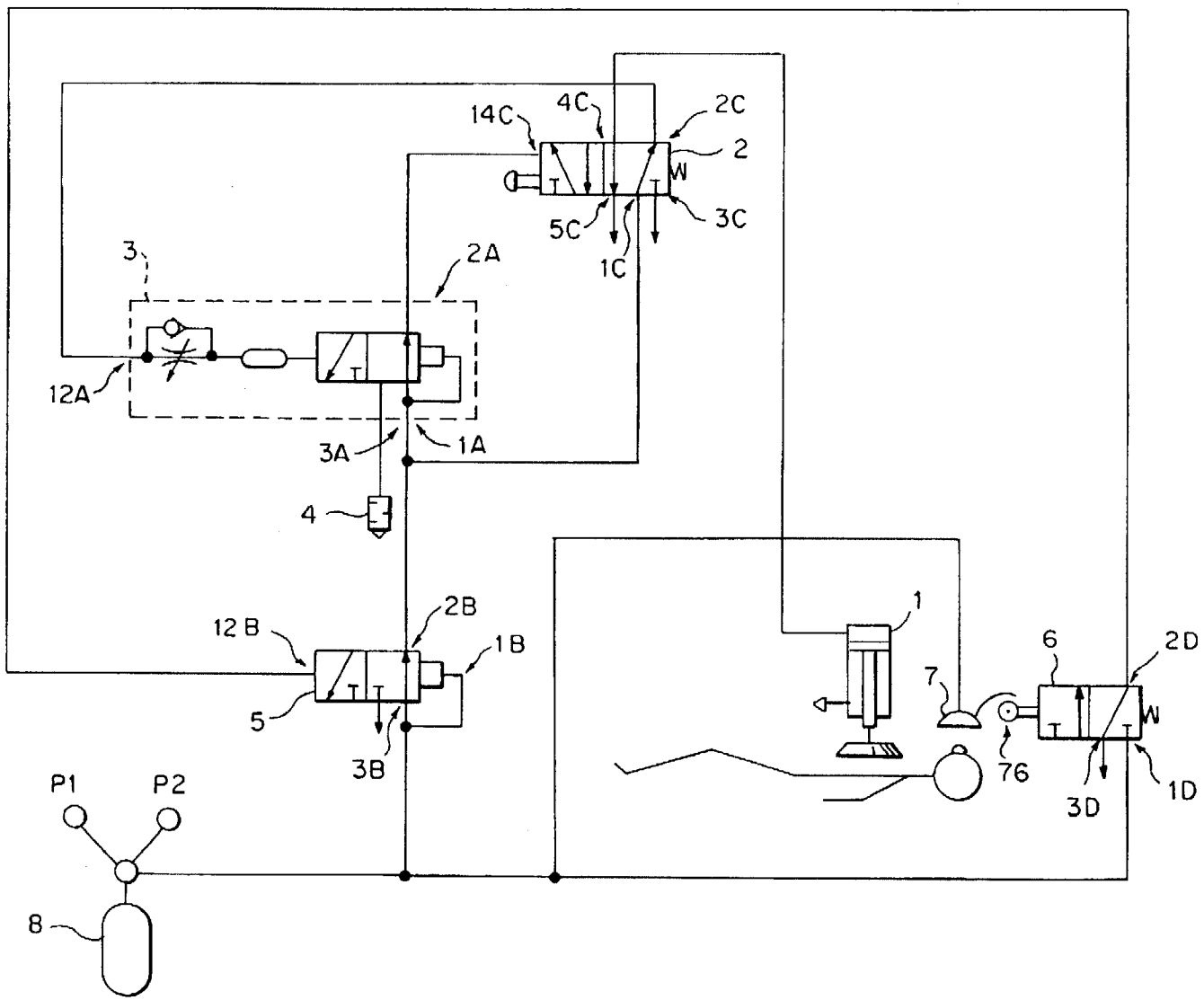
FIG. 2 is a more detailed sketch indicating the control system for the apparatus according to the invention.

To use the apparatus, the patient is positioned in the apparatus such that the sternum is situated below cylinder 1. This is lowered down until it touches the breast bone. The part of the cylinder 1 that contacts the chest of the injured person may be designed in different ways. In one favorable embodiment it is designed as a suction cup. This provides a decompression which will promote the flow of oxygen and blood, since the chest will be slightly elevated. Pressure P2 is applied to the apparatus from a gas (eg. oxygen, air, or Entonox) source such as a pressure cylinder 8. If a cylinder is used the secondary low pressure P2 after the conventional first-stage reduction at P1 may be used. The respiratory medium, preferably oxygen, will then pass through gate 3B to 2B (which is open) of valve 5 to the time regulated valve 3, gate 1A, which is closed, and to gate 1C of the unistable valve 2. The demand bypass valve 6 includes a port 3D which deaerates the line to the time-regulated valve 3 (through the port 2D) when the valve 6 is closed.

This directs the respiratory medium or oxygen out to gate 2C up to 12A on the time regulated valve 3. Timing commences controlled by the control link 4 including an adjustable throttle and a silencer. When the correct time is reached the valve is readjusted so that pressure exerted at gate 1A now goes out at gate 2*a* and proceeds on to gate 14*c* of the unistable valve 2.

This valve is then readjusted so that the pressure now moves from gate 1C and out at 4C, and into the cylinder which then exerts its thrust while the pressure at gate 12A of the time valve is discharged at gate 2C to gate 3C of the unistable valve 2. Port 5C is a discharge port.

The discharge of the control pressure at gate 14C of the unistable valve 2 begins, but will take some time through the throttling in outlet gate 3A in the time regulated valve 3. When this pressure has decreased to below 3.5 bar, the unistable valve 2 is switched over to the starting position again, and a new cycle begins. There are normally are applied 60–65 thrusts per minute.

When the cylinder exerts its thrust, it applies about 40 mm of effective compression onto the chest due to suspension/cushioning in the structure.

The ventilation of the patient is accomplished in the following manner:

A manual or automatic valve 6 is placed on the breathing mask 7, exerting pressure at gate 1D. Valve 6 is activated at the same time as the switch 76 for release of the respiratory medium in the mask is activated. The pressure regulated valve 5 thereby acquires control pressure, and the connection between 1B and 2B is closed. The pulsing stops, the cylinder will return to position as its contents are discharged, and the respiratory medium is simultaneously filled into the patient's lungs.

The consumption of respiratory medium is about 11N1/min. at a pressure of 6.3 bar, and at a rate of 60 thrusts/min.

The valves in the present invention may be described according to standard terminology as, e.g., "3/2" (meaning a valve with 3 ports and 2 positions) or "5/2" (meaning 5 ports and 2 positions).

I claim:

1. A mobile cardiac massage apparatus for use on a person in conjunction with a thrusting device (1) for providing of cardiac compression and a pressure source (8) providing a medium suitable for supplying to a person with reduced or interrupted lung function;

the apparatus comprising:

(i) automatic control means for actuating cardiac compression, the automatic control means including a 3/2 pressure-regulated valve (5) opened in a start phase of a cardiac compression cycle, a time-regulated valve, operatively connected to the pressure-regulated valve, (3) closed in the start phase and including a control link (4), the control link including means to determine a duration of the cardiac compression, and a 5/2 unistable valve operatively connected to the pressure-regulated valve and the time-regulated valve, (2) accepting pressure from the pressure-regulated valve, selectively transmitting pressure to the time-regulated valve and capable of selectively transmitting pressure to thrusting device;

(ii) a breathing mask, operatively connected to the automatic control means, (7) including a switch;

(iii) a normally-closed demand bypass valve (6), connected to the pressure-regulated valve (5) and adapted to connect with a pressure source, the demand bypass valve including means (7), for opening the demand bypass valve to transmit pressure to the pressure-regulated valve in response to activation of the switch on the breathing mask (5).

2. The apparatus according to claim 1, wherein the switch is manually operated and includes means for selecting just one of cardiac compression by the thrusting device and supplying of the medium to the person.

3. The apparatus according to claim 1, including means to open the demand bypass valve (6) whenever the breathing mask is in place on the person.

* * * * *